United States Patent [19]

Münzel et al.

[11] 4,240,350

[45] Dec. 23, 1980

[54] ELECTRONIC FUZE

[75] Inventors: Klaus Münzel, Klingnau; Panayotis Karayannis, Zurich; Hansjörg Naef, Buchs, all of Switzerland

[73] Assignee: Werkzeugmaschinenfabrik Oerlikon-Bührle, Zurich, Switzerland

[21] Appl. No.: 939,861

[22] Filed: Sep. 5, 1978

[30] Foreign Application Priority Data

Sep. 16, 1977 [CH] Switzerland ..... 11331/77

[51] Int. Cl.[3] ..... F42C 11/06

[52] U.S. Cl. ..... 102/215; 102/206

[58] Field of Search ..... 102/215, 218–220, 102/206, 207

[56] References Cited

U.S. PATENT DOCUMENTS 3,967,554 7/1976 Troyer, Jr. ..... 102/215

*Primary Examiner*—Charles T. Jordan

*Attorney, Agent, or Firm*—Werner W. Kleeman

[57] ABSTRACT

In an electronic fuze for a projectile the ignition energy, upon firing of the projectile, is produced by a generator and stored in a storage capacitor. An electronic circuit serving for the barrel safety i.e. to prevent premature detonation of the projectile in front of the barrel, delaying ignition upon impact, the delay-free ignition upon impact and the self-destruction of the projectile, controls the delivery of the energy stored in the capacitor to the detonator or ignition cap. To ensure that the energy of the storage capacitor is sufficient the electronic circuit of the fuze must work with extremely low current. This is realized by providing for the circuit a stabilizer, a switching-on element, resetting elements, blocking elements and time-delay elements, the stabilizer and time-delay elements being structured as solid-state circuits.

4 Claims, 4 Drawing Figures

STABILIZER

U3
16
OSC.
C
R1
6
BLOCKING ELEMENT
T19
SWITCHING ELEMENTS
32
31
h
a
g
f
d
e
GATE
33
11
RESET ELEMENT
12
37
38
39
35
36
GATES
RESET ELEMENT
RESET ELEMENT
J4
10
8
SWITCH-ON ELEMENT
INVERTERS
J1
J2
J3
R3
CONSTANT CURRENT SOURCE
30
24
U1
U2
26
T11
T10
27
U0

TIME DELAY CIRCUIT

ELECTRONIC FUZE

BACKGROUND OF THE INVENTION

The present invention relates to a new and improved construction of an electronic fuze for a projectile, which is of the type comprising a generator for generating the ignition energy, a storage capacitor in which there is stored the energy produced by the generator upon firing of the projectile, an ignition or detonator cap which is ignited by the energy stored in the storage capacitor, and an electronic circuit which serves for the barrel safety when the projectile is in front of the firing barrel, for delaying ignition upon impact, for the delay-free ignition upon impact and the self-destruction of the projectile.

SUMMARY OF THE INVENTION

It is a primary object of the present invention to provide a new and improved construction of an electronic fuze having an electronic circuit for the weapon barrel safety when the projectile is located in front of the barrel after firing, for self-destruction and selectively for delaying the ignition upon impact or for the immediate ignition upon impact, the electronic fuze requiring so little current that there suffices the energy of a single storage capacitor.

Yet a further significant object of the present invention aims at a new and improved construction of an electronic fuze working with very low energy requirements, which is extremely simple in design, highly reliable in operation, and not readily subject to breakdown or malfunction.

Now in order to implement these and still further objects of the invention, which will become more readily apparent as the description proceeds, the electronic fuze of the present development contains an electronic circuit of the previously mentioned type which, according to important aspects of the present invention, embodies a stabilizer which exclusively is constructed of elements which collectively form a solid-state circuit. Further, the electronic circuit comprises a switching-on element operatively connected with resetting elements and blocking elements, and time-delay elements which likewise are composed of elements which collectively form a solid-state circuit.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
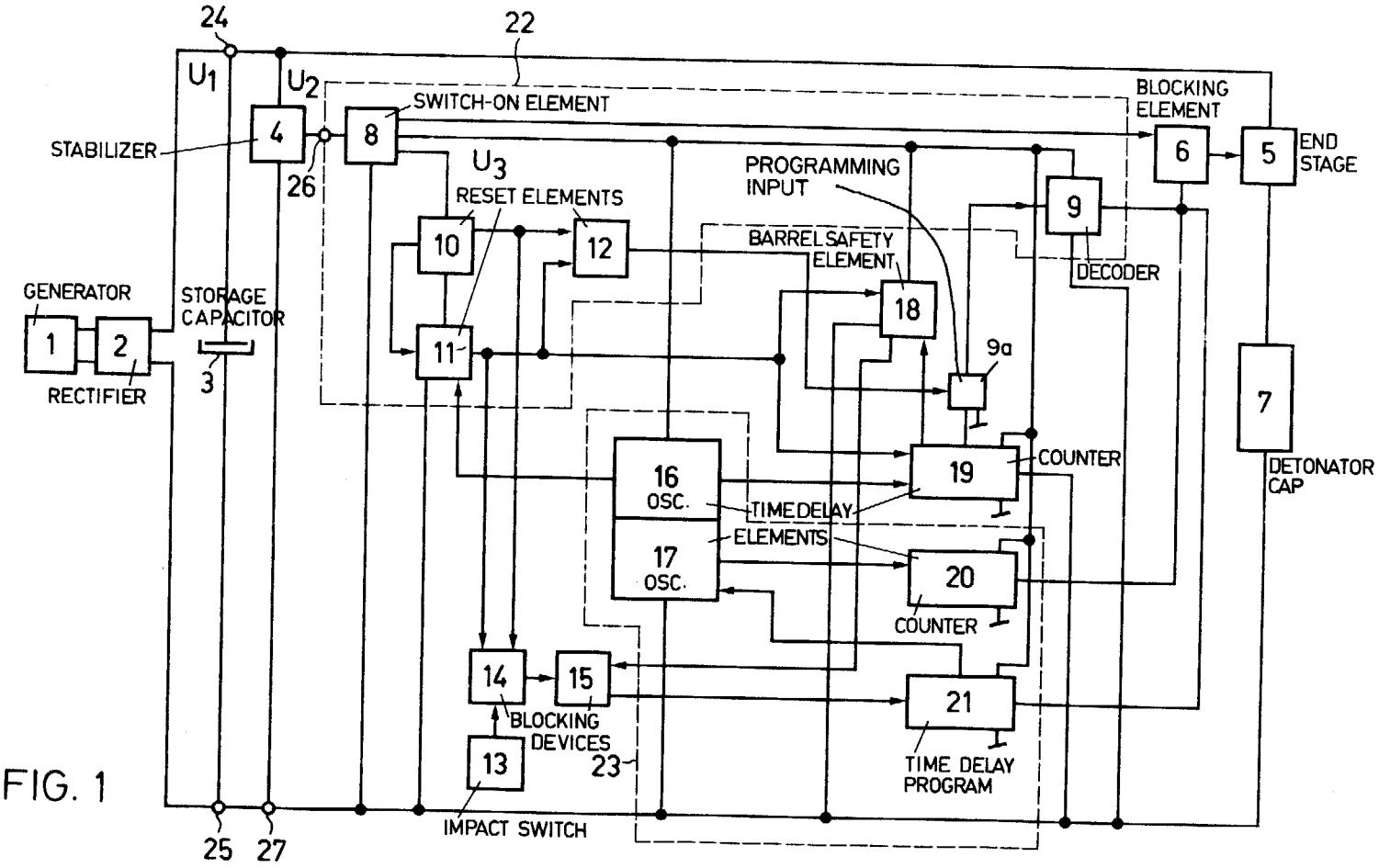
FIG. 1 is a circuit diagram of an electronic fuze constructed according to the teachings of the present invention.

(1) The General Construction of the Electronic Fuze (FIG. 1)

Describing now the drawings, the electronic fuze as shown in FIG. 1, and constructed according to the teachings of the present invention, will be seen to comprise a generator 1 constituted, for instance, by a surge generator which produces the energy required by the fuze by the firing acceleration of the projectile. There also can be used, however, a rotating generator which generates the energy needed by the electronic fuze due to the spin acceleration of the projectile.

A bridge-connected rectifier 2 is connected with the generator 1 and renders possible storage of the energy produced by the generator 1 in a storage capacitor 3.

Since the electrical energy stored in the storage capacitor 3 rapidly decreases upon its removal and thus is not constant, and for the purpose of reducing the current consumption, there is connected to the storage capacitor 3 a stabilizer 4 which regulates the supply voltage to a low level. This stabilizer or stabilizer circuit 4 has been illustrated in detail in FIG. 2 and will be described more fully in conjunction therewith.

Connected with the stabilizer 4 is a switching-on element or circuit 8 and a final stage 5 for igniting a detonator or ignition cap 7. A blocking element 6 ensures that the detonator or ignition cap 7 will be not prematurely ignited.

The blocking element or circuit 6 has been shown in greater detail in the circuit arrangement of FIG. 3 and will be described more fully hereinafter. The end or final stage 5 contains a thyristor or a transistor as the power switch. Connected with the switching-on element or circuit 8 are three reset or restoring switches 10, 11 and 12 by means of which it is possible to reset a counter 19 and an element 18 serving for the barrel safety when the projectile is located in front of or near the mouth of the barrel in its starting position. The counter 19 is connected with a decoder 9 by means of which it is possible to trigger the aforementioned detonator or ignition cap 7.

The last-mentioned elements, shown enclosed in a phantom or dash-line block 22, have been illustrated more fully in FIG. 3 and will be described in greater detail hereinafter.

Futhermore, connected with the switching-on element 8 are two oscillators 16 and 17 whose oscillations can be counted by two counters 19 and 20, in order to ensure for, for instance, the above-mentioned barrel safety and the self-destruction of the projectile. Elements or circuit 21 serving for providing a time-delay program are connected both with the oscillator 17 and with the blocking device 6. The counter 19 can be set in accordance with the desired barrel safety and the desired self-destruction time and the counter 19 can be set in accordance with the desired impact delay time i.e. the ignition delay upon impact.

The decoder 9 has programming inputs or input means 9*a* in order to set the self-destruction time.

Both of the oscillators 16 and 17, the counter 20 and the elements or circuit 21 for the time-delay program, which have been enclosed by a broken line block 23, have been illustrated more fully in FIG. 4 and will be described in detail in conjunction therewith.

Finally, the electronic fuze will be seen to also encompass an impact switch 13 which is connected by means of two blocking devices 14 and 15 with the elements 21 for the time-delay program. The blocking device 14 is controlled by the reset switches 10 and 11 and the blocking device 15 is controlled by the element 18 for the barrel safety.

The elements 21 for the time-delay program render possible, also upon impact ignition, by means of the impact switch 13 a time-delay of the ignition in order that, for instance, the projectile can penetrate the target.

Figure 2:
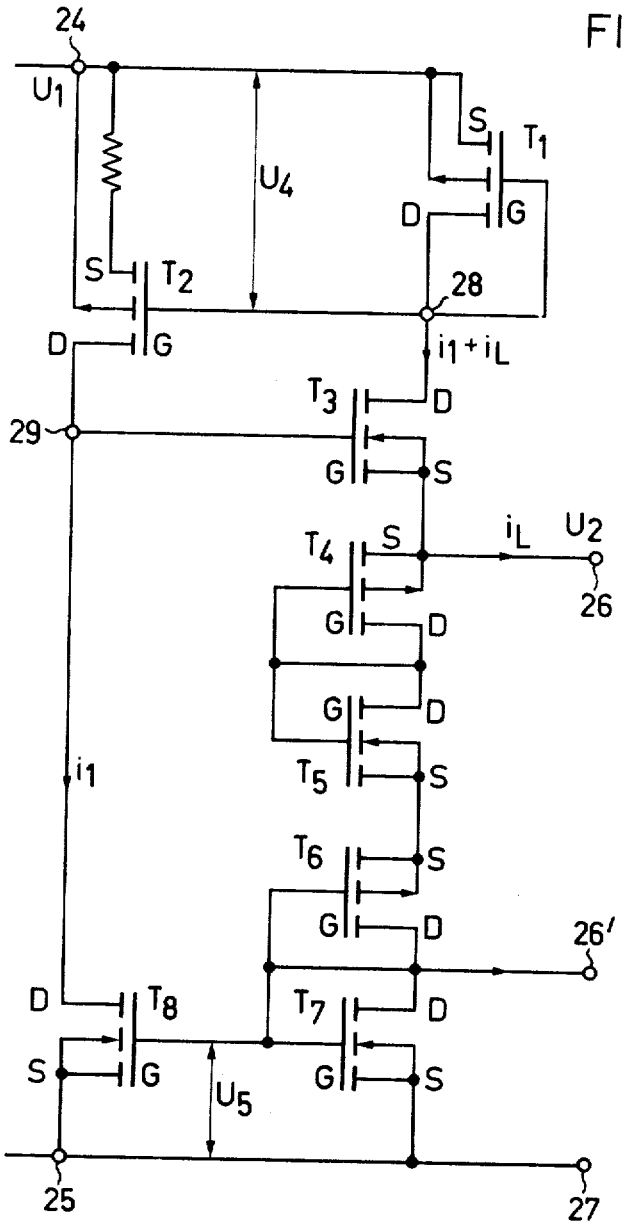
FIG. 2 is a circuit diagram illustrating details of a stabilizer used in the electronic fuze of FIG. 1.

(2) The Stabilizer (FIG. 2)

According to the showing of FIG. 2 the stabilizer will be seen to contain eight MOSFET-transistors $T_1$, $T_2$, $T_3$, $T_4$, $T_5$, $T_6$, $T_7$ and $T_8$ (metal-oxide-semiconductor-field-effect-transistors). The construction and operation of such type transistors are well known in the electronics art and therefore need not here be further considered. Each of the transistors $T_1$ to $T_8$ will be seen to have three terminals, conventionally designated as the source S, the drain D and the gate G. The transistors $T_1$, $T_2$, $T_4$ and $T_6$ have P-type channels and the transistors $T_3$,$T_5$, $T_7$ and $T_8$ possess N-type channels. These transistors all may be of the enhancement type.

A voltage source, particularly the storage capacitor 3 illustrated in FIG. 1, is connected with the terminals 24 and 25, whereas at the terminals 26 and 27 there is connected the load, i.e., the elements which have been enclosed by the phantom or dash lines 22 and 23 in FIG. 1. The storage capacitor 3 supplies the voltage $U_1$. The load requires a voltage $U_2$.

The terminals 24 and 25 are interconnected, on the one hand, by the two transistors $T_2$ and $T_8$ and, on the other hand, in parallel thereto by the six transistors $T_1$, $T_3$, $T_4$, $T_5$, $T_6$ and $T_7$. The terminals 26 and 27 are interconnected by means of the four transistors $T_4$, $T_5$, $T_6$ and $T_7$.

As to the transistor $T_1$ the gate G and drain D are connected with one another, thus producing an approximately constant voltage $U_4$ between the terminal 24 and the terminal 28. At this terminal 28 there is connected the gate G of the transistor $T_2$. The transistor $T_1$ thus controls the transistor $T_2$ and causes a constant current to flow in the circuit connection between the transistor $T_2$ and the transistor $T_8$.

In the case of the transistors $T_4$, $T_5$ and $T_6$ the respective gates G and drains D are connected with one another, producing a constant potential drop between the terminal 26 and the terminal 26'. The voltage $U_5$ is therefore dependent upon the voltage $U_2$. By means of the voltage or potential difference $U_5$ the transistor $T_8$ is controlled.

The mode of operation of the described stabilizer or stabilizer circuit is as follows:

The current requirements of the load alters and causes fluctuations of the voltage $U_2$, and thus, also fluctuations in the voltage or potential difference $U_5$. With a large current requirement of the load the voltage $U_2$ drops and there also is a drop in the potential or voltage difference $U_5$. This reduction of the voltage $U_5$ causes the resistance of the transistor $T_8$ to increase, and therefore, also produces an increase of the voltage at the terminal 29 and at the gate G of the transistor $T_3$ and a greater amount of current flows through the transistor $T_3$. As a consequence the voltage $U_2$ again increases.

In the case of smaller current requirements of the load the voltage $U_2$ increases, and therefore, also the voltage $U_5$ increases. This increase of the voltage difference $U_5$ causes the resistance of the transistor $T_8$ to become smaller, and therefore, there is also a reduction of the voltage at the terminal 29 and at the gate G of the transistor $T_3$ and less current flows through the transistor $T_3$. As a consequence the voltage $U_2$ again drops.

The voltage drop $U_4$, apart from being dependent upon the characteristics of the transistor $T_1$, also depends upon the load current $i_L$ of the load. With large current $i_L$ the potential difference $U_4$ become greater, and thus, the resistance of the transistor $T_2$ becomes smaller. A greater amount of current flows through the transistor $T_2$ and therefore more current flows through the transistor $T_1$. With small current $i_L$ the voltage difference $U_4$ becomes smaller, and thus, the resistance of the transistor $T_2$ becomes greater. Almost the same amount of current flows through the transistor $T_2$ as through the transistor $T_1$.

The transistors $T_1$, $T_2$, $T_4$, $T_5$, $T_6$ and $T_7$ work in the saturation region. The transistor $T_3$ functions as an impedance converter. The reference voltage is the threshold voltage of the transistor $T_8$. The transistor $T_1$ produces in accordance with its characteristics and the magnitude of the load current $i_l+i_L$ the voltage or potential difference $U_4$. In analogous manner the transistor $T_7$ generates the potential of voltage difference $U_5$ in accordance with its characteristics and the current $i_l$ flowing through the transistors $T_4$, $T_5$, $T_6$ and $T_7$ the voltage difference $U_5$.

The potential or voltage difference $U_4$ renders possible the control of the transistor $T_2$ which serves as a current source. The potential difference $U_5$ renders possible the control of the transistor $T_8$. The transistors $T_4$, $T_5$, $T_6$ and $T_7$ serve as voltage dividers.

Figure 3:
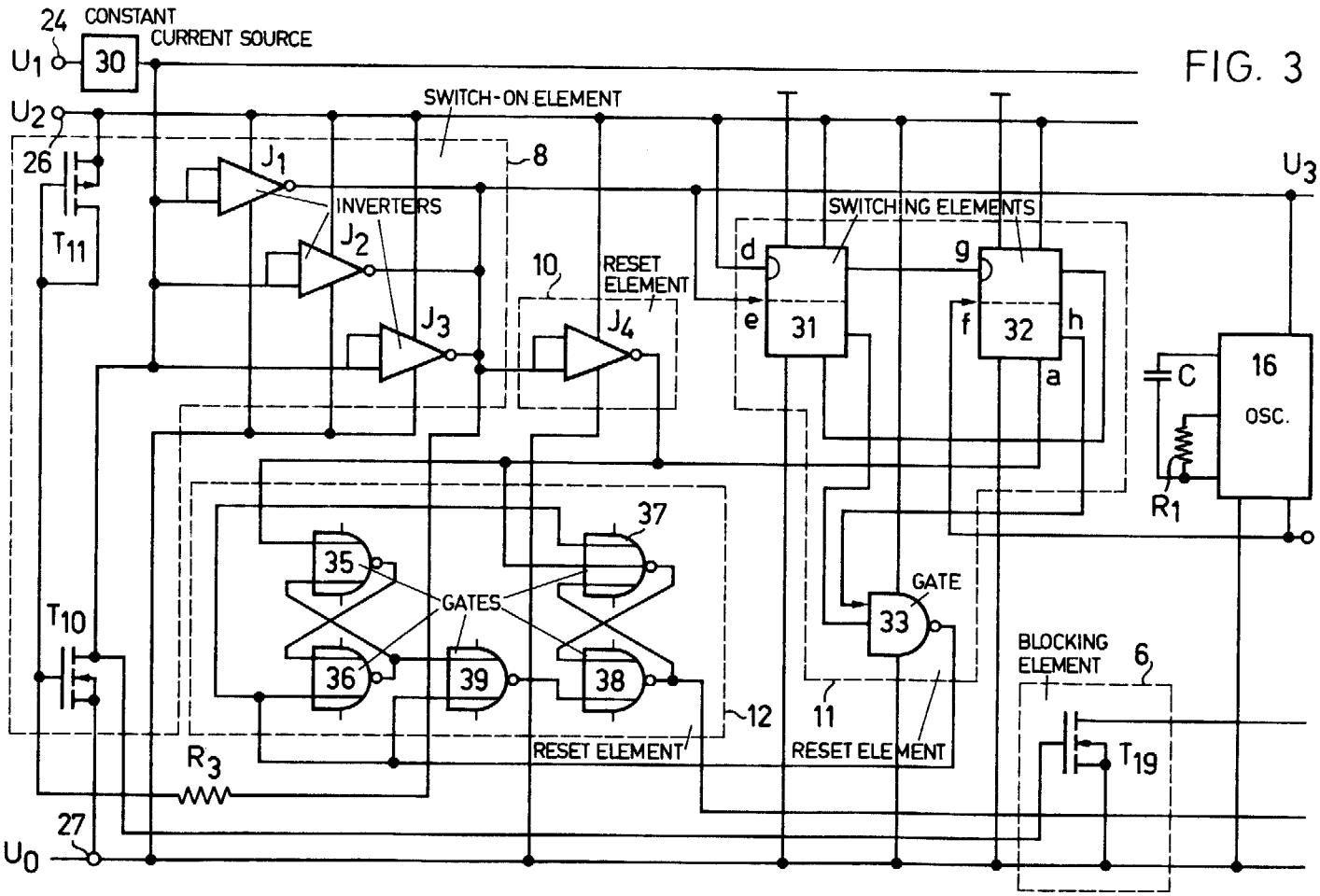
FIG. 3 is a circuit diagram illustrating details of the switch-on elements used in the circuit arrangement of fuze of FIG. 1.

(3) The Switching-On and Resetting Elements (FIG. 3)

The switching-on circuit or element 8 (FIG. 1), as best seen by referring to FIG. 3, comprises three inverters $J_1$, $J_2$ and $J_3$, two transistors $T_{10}$ and $T_{11}$ and a constant current source 30. The supply voltage for the three inverters $J_1$, $J_2$ and $J_3$ is delivered by the stabilizer 4 (FIG. 1), and therefore, the inverters $J_1$ $J_2$ and $J_3$ are connected with the output terminals 26 and 27 of the stabilizer 4 according to FIG. 2. As shown, the inputs of the three inverters $J_1$, $J_2$ and $J_3$ are connected with the constant current source 30 which, in turn, is connected with the input terminal 24 of the stabilizer 4 and by means of the transistor $T_{10}$ also with the output terminal 27. The outputs of the three inverters $J_1$, $J_2$ and $J_3$ are connected by means of a resistor $R_3$ and via transistor $T_{11}$ with the output terminal 26 of the stabilizer 4.

At the output of the switching-on element or circuit 8, i.e., at the outputs of the inverters $J_1$, $J_2$ and $J_3$ there is connected the first resetting switch 10 (FIG. 1) composed of a fourth inverter $J_4$, the supply voltage of which likewise is delivered by the stabilizer 4, i.e., by the terminals 26 and 27.

Apart from the switching-on element 8 and the resetting switch 10 there is furthermore provided a second resetting switch 11 composed of two switching elements 31 and 32 and a gate 33. The first switching element 31 has two inputs d and e, wherein the input d is connected to the terminal 26 and the other input e to the output of the switching-on element 8, i.e., with the outputs of the inverters $J_1$, $J_2$ and $J_3$. Further, the first switching element 31 has two outputs, one of which is connected with gate 33 and the other with the first input g of the switching element 32. The second switching element 32 likewise has two inputs g, f wherein the one is connected with an output of the switching element 31 and the other with the oscillator 16 (FIGS. 1 and 3). Additionally, the second switching element 32 has two outputs, wherein the one is connected with the third input of the first switching element 31 and the other with the aforementioned gate 33.

The third resetting switch 12 consists of two gates 35 and 36 forming an intermediate storage and further comprises two gates 37 and 38 which form a flip-flop circuit. A further gate 39 is arranged in circuit between the gates 35, 36 and 37, 38. The reset circuit 12 is connected with the reset switch 10, i.e., with the inverter $J_4$ and with the reset switch 11, i.e., at the common gate 33 of both switching elements 31 and 32. In the case of the reset switch 12 and the output of one gate 35 is connected with an input of the other gate 36, whose output likewise is connected with the input of the gate 35. Equally, in the case of the resetting or reset switch 12 the output of the one gate 37 is connected with one input of the other gate 38, the output of which again is connected with an input of the gate 37. Hence, the gates 35 and 36, on the one hand, and the gates 37 and 38, on the other hand, each form a respective flip-flop circuit. The gate 39 located between the gates 35, 36 and 37, 38 is connected with its output at an input of the gate 38 and with its two inputs this gate 39 is connected, on the one hand, with the gates 35, 36 and, on the other hand, with the aforementioned common gate 33 of both switching elements 31 and 32 of the resetting switch 11, as shown. The mode of operation of the described switching-on or switching and resetting elements is as follows:

Upon firing of the projectile the generator 1 (FIG. 1) produces a current which by means of the bridge-connected rectifier 2 (FIG. 2) and by means of the internal resistance of the generator 1 charges the storage capacitor 3 (FIG. 1), with the result that there is built-up the voltage $U_1$ (FIG. 3). The constant current source 30 (FIG. 3), which need not here be further described, delivers a current as long as the transistor $T_{10}$ is still in its non-conductive state, and which current also causes a rise of the potential at the inputs of the three inverters $J_1$, $J_2$ and $J_3$ approximately to the voltage or potential $U_1$. The aforementioned input voltage $U_1$ causes the inverters $J_1$, $J_2$ and $J_3$ to become conductive and there is formed at their outputs the mass or ground potential $U_o$. Since the outputs of the inverters $J_1$, $J_2$ and $J_3$ are connected by means of the resistor $R_3$ also with the gates of the transistors $T_{10}$ and $T_{11}$, the transistor $T_{11}$ becomes conductive as soon as the stabilizer 4 has generated the voltage $U_2$. Consequently, a current flows from the terminal 26 through the transistor $T_{11}$ to the outputs of the three inverters $J_1$, $J_2$ and $J_3$. This current increases and causes the transistor $T_{10}$ to also become conductive, so that the input voltage of the inverters $J_1$, $J_2$ and $J_3$ drops from the value $U_1$ to the value null. The disappearance of the input voltage $U_1$ at the inverters $J_1$, $J_2$ and $J_3$ and the build-up of its supply voltage $U_2$ has as a consequence thereof that the voltage $U_3$ also builds-up at its outputs. This procedure is accelerated by the resistance R which acts as a coupling element.

At the inverter $J_4$ there occurs the converse procedure. At the input of the inverter $J_4$ there initially prevails the voltage $U_o$, which, as further explained above, is produced at the outputs of the three inverters $J_1$, $J_2$ and $J_3$. Thus, there appears at the output of the inverter $J_4$ likewise the voltage $U_2$ and generates a first resetting pulse. This first resetting pulse disappears as soon as there appears at the outputs of the inverters $J_1$, $J_2$ and $J_3$ the voltage $U_2$.

The aforementioned first resetting or reset pulse has the following effect:

(1) The switching element 32 receives the first resetting or reset pulse at the input a (the reset input).

(2) The switching element 31 furthermore receives a voltage pulse $U_2$ at the input d.

(3) This voltage pulse $U_2$ first is effective however when the switching element 31 receives at its input e the voltage pulse $U_3$ from the switching-on element 8.

(4) The switching element 31 synchronously changes its state in accordance with the pulse $U_3$ from the value 0 to the value 1.

(5) The voltage $U_3$ also turns-on the oscillator 16.

(6) As soon as the oscillator 16 delivers a first oscillation pulse at location f to the switching element 32, then the output pulse "1" of the switching element 31 is delivered further at location g by the switching element 32 and the output h of the switching element 32 delivers a logic pulse "1" to the gate 33.

(7) The switching element 31, as discussed above in sub-paragraph (3), has received at its input e the voltage pulse $U_3$ and thus produces an output pulse which likewise is delivered to the gate 33.

(8) As soon as the oscillator 16 delivers a second oscillation pulse then the switching element 32 is switched and delivers a logic pulse "0" to the gate 33.

(9) The switching element 31 thus delivers continuously pulses "0" to the gate 33, and the switching element 32, during the second oscillation pulse of the oscillator 16, likewise delivers a logic pulse "0" to the gate 33, so that the gate 33 delivers a second resetting or reset pulse.

Both of the resetting pulses have the following effect:

(1) The gates 35 and 36 of the resetting switch 12 are turned-on by means of the first resetting pulse and are switched back by means of the second resetting pulse. They serve only as an intermediate storage, since the edge slope of the switching-on element 8 causes a delay of the second resetting pulse.

(2) The gates 37 and 38 on the other hand are either turned-on by the first resetting pulse or by the second resetting pulse and only upon disappearance of the second resetting pulse are again switched back.

(3) The signal generated by the resetting switch 12 annihilates the blocking action of the counter 19.

The function of the resetting switch 12 is well known and need not be here further considered.

Figure 4:
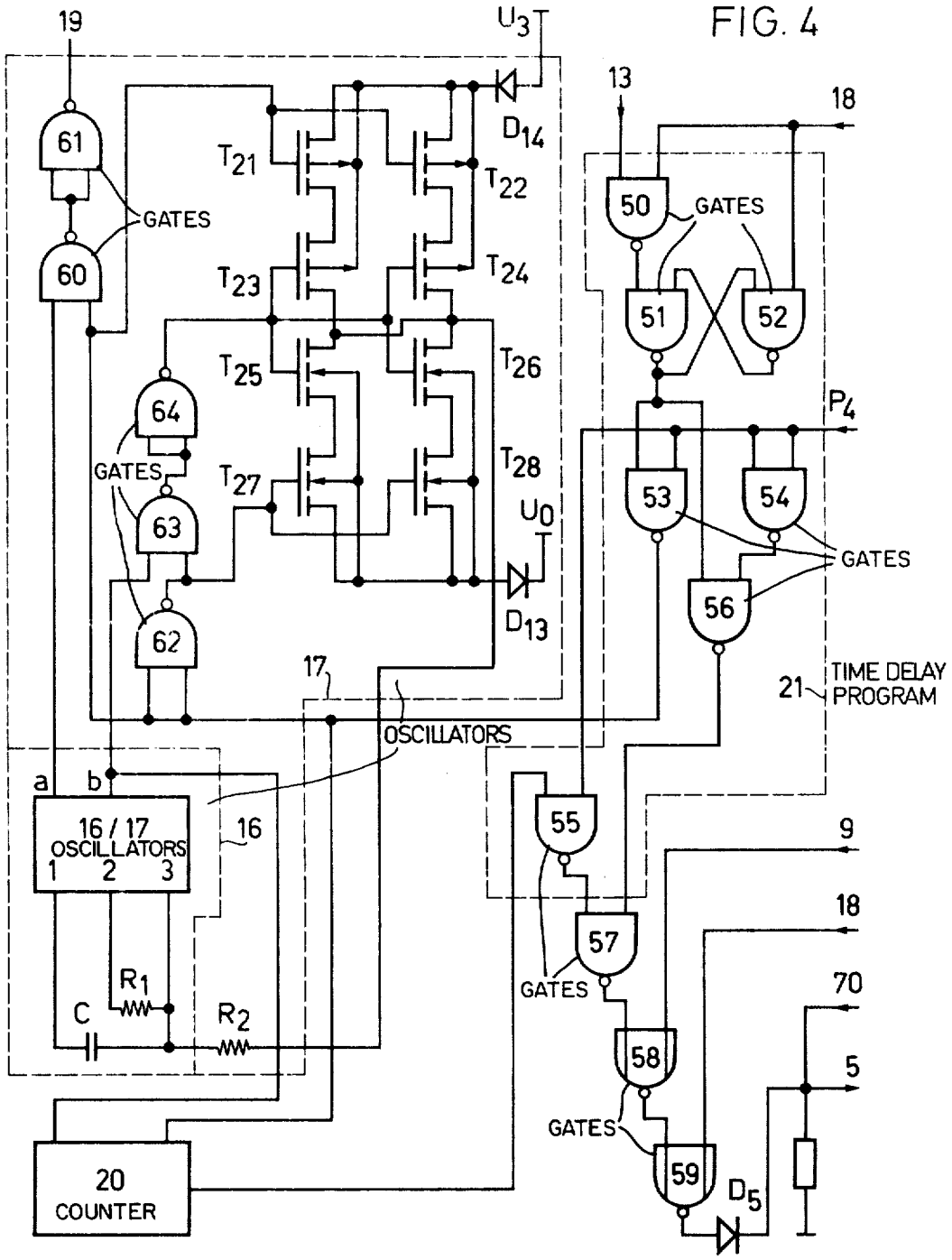
FIG. 4 is a schematic illustration of time-delay elements used in the circuit arrangement of electronic fuze of FIG. 1.

(4) The Time-Delay Elements (FIG. 4)

The time-delay elements of FIG. 4 will be seen to comprise the two oscillators 16 and 17 which have been shown separately in FIG. 1, but however have a partially common RC-element. This RC-element for the oscillator 16 consists of the capacitor C and the resistor $R_1$ and for the oscillator 17 consists of the same capacitor C and a different resistor $R_2$. The remaining parts of both oscillators 16 and 17 are arranged in a housing designated by reference characters 16/17. With the broken line block 16 there is indicated the complete oscillator 16 and with the broken line block 17 there is indicated the complete oscillator 17.

The oscillator 16 is connected at location a by means of two gates 60 and 61 with the counter 19 (FIG. 1) for the barrel safety. The oscillator 17 is connected at location b by means of two gates 63 and 64 at the time-delay program 21 illustrated in FIGS. 1 and 4.

A group of eight transistors $T_{21}$, $T_{22}$, $T_{23}$, $T_{24}$, $T_{25}$, $T_{26}$, $T_{27}$ and $T_{28}$ in conjunction with the three gates 62, 63 and 64 serves for switching both of the oscillators 16 and 17, for instance, for turning-off the oscillator 16 and for turning-on the oscillator 17.

This switching operation is needed since there is required for the barrel safety a different frequency than for the impact time-delay. For the barrel safety there is employed, for instance, a frequency of 500 Hz and for the impact time-delay there is used, for instance, a frequency of 35 kHz.

In order to avoid any feedback effects of the oscillator 16 at the voltage source, which causes a frequency change, the aforementioned eight transistors $T_{21}$ to $T_{28}$ are connected, on the one hand, by means of two diodes $D_{13}$ and $D_{14}$ with the voltage $U_3$ and, on the other hand, with the voltage $U_0$.

Apart from both of the oscillators 16 and 17 the time-delay elements also have a group of ten gates 50 to 59. Of these ten gates 50 to 59 the gate 50 is connected on the one hand by means of both inputs with the impact switch 13 (FIG. 1), and, on the other hand, with the element 18 for the barrel safety (FIG. 1).

The flip-flop circuit of the gates 51 and 52 is connected with the gate 50 and the element 18.

The gate 53 is connected, on the one hand, with a first of its inputs at the output of the flip-flop circuit 51, 52 and, on the other hand, is connected by means of a second input at a program switch $P_4$. This program switch $P_4$ delivers a logic "1" signal or pulse when there is desired an impact time-delay i.e. a delay in the ignition upon impact and it delivers a logic signal or pulse "0" when there is not desired any impact delay. Furthermore, connected with this program switch $P_4$ are both inputs of the gate 54. The output of the gate 53 leads to the gates 62 and 60 of the oscillators 16 and 17 and to the time-delay counter 20.

The gate 56 is connected with the output of the flip-flop circuit 51, 52 and with the gate 54.

The gate 55 is connected by means of one of its inputs with the program switch $P_4$ and by means of its other input with the time-delay counter 20 (FIGS. 1 and 4) which exclusively counts the pulses of the oscillator 17.

Both of the inputs of the gate 57 lead to the outputs of the gates 55 and 56. The one input of the gate 58 leads to the output of the gate 57, whereas the other input of the gate 58 leads to the decoder 9 for the self-destruction. Finally, the one input of the gate 59 leads to the output of the gate 58, whereas the other input of the gate 59 leads to the element 18 for the barrel safety. The output of the gate 59 is connected with the end or final stage 5 (FIG. 1) which contains a thyristor for igniting the detonator or ignition cap 7 (FIG. 1). A not particularly illustrated blocking device 70 is connected with the end stage 5. Blocking 70 is controllable by means of the resetting switch 12 (FIG. 1). This blocking device 70 is capable of preventing a pulse delivered by the gate 59 from reaching the end or final stage 5.

The mode of operation of the described time-delay elements is as follows:

(1) Initially it is assumed that no impact delay i.e. delay in ignition upon projectile impact is desired. The program switch $P_4$ thus delivers a logic signal "0" or binary pulse "0". As soon as the projectile strikes the target then the impact switch 13 generates a logic pulse "1". If after impact the projectile is at a sufficiently great distance from the gunner, then the element 18 for the barrel safety also delivers a logic pulse "1". Thus, the gate 50 switches from the logic pulse "1" to the logic pulse "0", and the flip-flop circuit 51 and 52 likewise switches and delivers the logic pulse "1" to the inputs of the gates 53 and 56. As mentioned, the program switch $P_4$ delivers to the gates 53 and 54 the logic pulse "0". Therefore, at the output of the gate 53 there appears the logic pulse "1". As a result the oscillator 16 is in operation while the oscillator remains blocked. Since the output of inverter 62 is at null the transistors $T_{27}$ and $T_{28}$ are blocked. The output of the inverter 64 is also null. At the output of the inverter 53 there is present a logic signal "1". The transistors $T_{21}$ and $T_{22}$ are blocked. The output of the inverter, formed by the transistors $T_{23}$ and $T_{26}$, is thus sufficiently highly ohmic that the resistor $R_2$ does not have any influence upon the frequency behavior of the oscillator 16. At the output of the gate 54 there appears, however, the pulse "1" and at the output of the gate 56 there likewise appears the pulse "0".

The gate 55 receives from the program switch $P_4$ the logic pulse "0" and from the counter 20 the logic pulse "1" and thus produces a logic pulse "1". Thus, the gate 57 receives a logic pulse "1" from the gate 55 and from the gate 56 receives a logic pulse "0" and therefore produces a logic pulse "1".

Prior to the self-destruction time the decoder 9 delivers a logic pulse "0" and the gate 58 receives from the gate 57 a logic pulse "1" and from the decoder 9 a logic pulse "0" and produces, in turn, a logic pulse "0". As above-mentioned the element 8 for the barrel safety produces the logic pulse "1" and after expiration of the barrel safety time switches to the logic signal "0". Thus, the gate 59 receives from the gate 58 and also from the element 18 the logic pulse "0" and produces a logic pulse "1" which is conducted to the end stage 5 provided that the blocking action of the blocking device 70 is eliminated. The ignition is thus accomplished without any time-delay.

(2) If an impact or ignition time-delay is desired, then the program switch $P_4$ delivers the logic pulse "1".

As soon as the projectile has hit the target then the impact switch 13 produces a logic pulse "1". As soon as after impact the projectile is at a sufficient distance from the gunner, then also the element 18 for the barrel safety delivers a logic pulse "1". Hence, the gate 50 switches from the logic pulse "1" to the logic pulse "0" and the flip-flop circuit 51 and 52 likewise switches and delivers a logic pulse "1" to the inputs of the gates 53 and 56. As mentioned, the program switch $P_4$ likewise delivers to the gates 53 and 54 the logic pulse "1". At the output of the gate 53 there thus appears the logic pulse "0" which is further delivered to the oscillator 17. At the output of the gate 54 there appears a logic pulse "0", and thus, also the gate 56 produces a logic pulse "1" and there is not possible any ignition without a time-delay, since now the gate 57 is blocked.

The logic pulse "0" from the gate 53 arrives at the gate 60, and the gate 60 thus blocks and counter 19 is turned-off. Additionally, the logic pulse "0" of the gate 53 is applied to the gate 62 and the transistors $T_{21}$ and $T_{22}$ and by means of the gate 62 to the transistors $T_{27}$ and $T_{28}$. The oscillator output b is conductively connected by means of the gates 63 and 64 with the transistors $T_{23}$, $T_{24}$, $T_{25}$ and $T_{26}$. These transistors work as inverters and their common output is connected with resistor $R_2$, whereby $R_2$ is $R_1$. The oscillator 17 now oscillates at the greater frequency of, for instance, 35 kHz and delivers pulses to the counter 20. The program switch $P_4$ delivers the logic pulse "1" and the output of the inverter 51 likewise delivers the logic pulse "1", and thus, the inverter 53 delivers at the output the logic pulse "0" and the counter 20 can begin to count. As soon as there have been counted the requisite number of pulses by the counter 20 then a logic pulse "1" is conducted to the gate 55 which likewise receives a logic pulse "1" from the program switch $P_4$. Thus, as above described, by means of the gates 57, 58 and 59 it is possible to energize the end or final stage 5 and to ignite the detonator or fuze 7.

While there are shown and described present preferred embodiments of the invention, it is to be distinctly understood that the invention is not limited thereto, but may be otherwise variously embodied and practiced within the scope of the following clams. ACCORDINGLY,

What we claim is:

1. An electronic fuze for a projectile having a barrel safety device, an ignition time-delay device, a delay-free ignition device and a self destruction device, comprising:

generator means for generating ignition energy for the projectile;

a storage capacitor for storing energy produced by the generator upon firing the projectile;

a detonator cap which is ignited by the energy stored by the storage capacitor;

an electronic circuit for the barrel safety, for ignition time-delay of the projectile upon impact, for the delay-free ignition upon impact and for the self-destruction of the projectile;

said electronic circuit comprising:

a stabilizer which is exclusively formed of components which collectively define a solid-state circuit;

resetting elements and blocking elements;

a switching-on element connected with said resetting elements and blocking elements; and time delay elements in circuit with said resetting elements and said blocking elements and formed of components which collectively form a solid-state circuit.

2. The electronic fuze for a projectile as defined in claim 1, wherein:

at least given ones of said components of said stabilizer define a constant current source;

said constant current source comprising a reference means providing a reference voltage and a resistance which can be controlled by said reference means ;

the current flowing through said resistance being substantially constant;

the current flowing through said reference means being variable;

an impedance converter defined by another of said components of said stabilizer and controllable by the output voltage of the stabilizer;

other of said components of said stabilizer defining a voltage divider for producing a partial voltage and having a reference transmitter controlling the impedance converter as a function of the partial voltage;

said components of the stabilizer being MOS-field-effect transistors of the enhancement type;

said reference means providing said reference voltage having a drain and gate which are interconnected with one another;

said resistance comprising a resistance means having a gate and drain; and the gate of the controllable resistance being connected with the gate of said reference means.

3. The electronic fuze for a projectile as defined in claim 1, wherein:

the switching-on element comprises three inverters having inputs and outputs;

means defining a constant current source for the switching-on element;

the inputs of the three inverters being connected with the constant current-source;

a first field-effect transistor for connecting the inputs of the three inverters with ground;

said field-effect transistor having a gate, drain and source;

a second transistor;

resistor means;

the gate of the first field-effect transistor being connected by means of said second transistor with said stabilizer and by said resistor means with the outputs of the inverters;

said resetting elements comprising:

a first resetting switch connected with the switching-on element;

a second resetting switch connected with the stabilizer; and a third resetting switch connected with said first and second resetting switches.

4. An electronic fuze for a projectile as defined in claim 1, wherein:

said time-delay elements comprise a first oscillator having a first counter for controlling the barrel safety and a second oscillator having a second counter for controlling the ignition time-delay upon impact of the projectile;

an impact switch cooperating with said time-delay elements;

both oscillators having a partially common RC-element;

the capacitor of the RC-element constituting said common RC-element for both oscillators;

each oscillator having its own resistor of the RC-element; and transistorized circuit means for selectively switching-on the one or the other oscillator.

* * * * *